US010501290B2

(12) United States Patent
Roodenburg et al.

(10) Patent No.: US 10,501,290 B2
(45) Date of Patent: Dec. 10, 2019

(54) DOUBLE JIB SLEWING PEDESTAL CRANE

(71) Applicant: ITREC B.V., Schiedam (NL)

(72) Inventors: Joop Roodenburg, Delft (NL); Hendrikus Jacobus Weterings, 's-Gravenzande (NL)

(73) Assignee: ITREC B.V., Schiedam (NL)

( * ) Notice: Subject to any disclaimer, the term of this patent is extended or adjusted under 35 U.S.C. 154(b) by 175 days.

(21) Appl. No.: 15/699,783

(22) Filed: Sep. 8, 2017

(65) Prior Publication Data

US 2018/0044148 A1 Feb. 15, 2018

Related U.S. Application Data

(62) Division of application No. 15/110,488, filed as application No. PCT/NL2014/050920 on Dec. 30, 2014, now Pat. No. 9,790,062.

(30) Foreign Application Priority Data

Jan. 10, 2014 (NL) ..... 2012074

(51) Int. Cl.

| | |
|---|---|
| ***B66C 23/52*** | (2006.01) |
| ***B66C 23/64*** | (2006.01) |
| ***B66C 23/66*** | (2006.01) |
| ***B66C 23/82*** | (2006.01) |

(52) U.S. Cl.

CPC ..... *B66C 23/52* (2013.01); *B66C 23/64* (2013.01); *B66C 23/66* (2013.01); *B66C 23/82* (2013.01)

(58) Field of Classification Search

CPC ..... B66C 23/62; B66C 23/64; B66C 23/66; B66C 23/82; B66C 23/06; B66C 23/18; B66C 23/36; B66C 23/525

See application file for complete search history.

(56) References Cited

U.S. PATENT DOCUMENTS

| | | | | |
|---|---|---|---|---|
| 3,591,022 | A | 7/1971 | Polyakov et al. | |
| 3,685,668 | A | 8/1972 | Suverkrop | |
| 4,363,410 | A | 12/1982 | Sprengel | |
| 2012/0241404 | A1 | 9/2012 | Bobeck | |
| 2015/0151953 | A1 * | 6/2015 | Weterings | B66C 13/08 212/273 |

(Continued)

FOREIGN PATENT DOCUMENTS

| | | |
|---|---|---|
| CN | 202744226 U | 2/2013 |
| EP | 2 194 017 A1 | 6/2010 |

(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A double jib stewing pedestal crane includes a main jib, a secondary jib, and a secondary jib positioning device to support and position the secondary jib with respect to the main jib and actuate the pivotal movement of the secondary jib. The secondary jib positioning device includes a secondary jib positioning cable, a spoke structure fixed to the secondary jib and extending radially outward, and a tension chain connected at one end to the secondary jib positioning cable and at the other end to the secondary jib and/or to the spoke structure. The spoke structure is adapted to support the tension chain.

5 Claims, 7 Drawing Sheets

(56) References Cited

U.S. PATENT DOCUMENTS

| | | | | |
|---|---|---|---|---|
| 2015/0203337 | A1* | 7/2015 | Roodenburg | B66C 23/52<br>212/309 |

FOREIGN PATENT DOCUMENTS

| | | | | |
|---|---|---|---|---|
| GB | 992832 | | 5/1965 | |
| WO | WO 2005/030632 | A1 | 4/2005 | |
| WO | WO 2008/088213 | A2 | 7/2008 | |
| WO | WO-2014014343 | A1 * | 1/2014 | B66C 23/52 |
| WO | WO 2014/025253 | A1 | 2/2014 | |
| WO | WO-2014025253 | A1 * | 2/2014 | B66C 23/52 |

* cited by examiner

DOUBLE JIB SLEWING PEDESTAL CRANE

CROSS-REFERENCE TO RELATED APPLICATIONS

This application is a Divisional of U.S. patent application Ser. No. 15/110,488 filed on Jul. 8, 2016, which was filed as the National Phase of PCT International Application No. PCT/NL2014/050920 filed on Dec. 30, 2014, which claims the benefit of priority from Dutch Application No. 2012074 filed in the Netherlands on Jan. 10, 2014, all of which are hereby expressly incorporated by reference into the present application.

The present invention relates to a double jib slewing pedestal crane comprising:

- a stationary pedestal;
- a crane housing mounted to the pedestal and adapted to slew relative to the pedestal about a vertical slew axis;
- a main jib comprising an outer end to which a jib axle is pivotably connected and an opposed inner end which is connected pivotably about a first horizontal pivot axis to the crane housing, allowing an up-and-down luffing movement of the main jib;
- a secondary jib comprising an inner end which is connected pivotably to the jib axle, allowing a pivotal movement of the secondary jib with respect to the main jib;
- an object suspension device to which an object is connectable;
- a hoist assembly comprising a hoist winch and an associated hoisting cable.

A conventional crane is provided with a hoist winch and a hoisting cable, extending from the hoist winch via sheaves over a departing sheave of a jib to an object suspension device, which crane can be used both to lift and lower materials and to move them horizontally. It is mainly used for lifting heavy things and transporting them to other places. The object suspension device preferably comprises a crane hook or the like to connect the load.

In a double jib slewing pedestal crane the jib comprises at least two parts: a main jib and a secondary jib. This provides a compact size for storage and maneuvering.

The double jib slewing pedestal crane has been particular advantageous for marine purposes as the secondary jib of the crane allows the crane to hoist loads with the tip of the secondary jib close to the vessel, in particular to the deck of the vessel. This way, movements of the load can be limited as the tip of the secondary jib can be kept at a limited height above deck. Also, as the force of the load is introduced at a lower point of the crane, the stability of the vessel is increased. These features makes the crane safe and efficient.

To operate the double jib stewing pedestal, both parts of the boom, the main jib and the secondary jib, are individually controlled. Hydraulic cylinders may be used, which are suitable for small double jib stewing pedestal cranes capable of hoisting loads from a few thousand kilos up to loads up to 50 tons. Upon further upscaling the double jib slewing pedestal crane to be able to hoist even larger loads, up to a few hundred tons, it has been found that the use of hydraulic cylinders may cause limitations in reach of the crane and the maximum load.

The aim of the present invention is to provide an alternative control mechanism for the main jib and the secondary jib of a double jib slewing pedestal crane.

This is achieved according to a first aspect of the present invention by a double jib slewing pedestal crane comprising:

- a stationary pedestal, preferably adapted to be mounted to a vessel;
- a crane housing that is mounted to the pedestal and adapted to slew relative to the pedestal about a vertical slew axis;
- a main jib comprising an inner end which is connected pivotably about a first horizontal pivot axis to the crane housing, allowing an up-and-down luffing movement of the main jib, and opposed thereof two forked outer ends between which a jib axle extends defining a second horizontal pivot axis;
- a luffing assembly comprising a luffing winch and a luffing cable extending between the main jib and the crane housing; and
- a secondary jib comprising a forked inner end defining a left-hand fork end and a right-hand fork end, which are connected pivotably to the jib axle, allowing a pivotal movement of the secondary jib with respect to the main jib;
- an object suspension device to which an object is connectable;
- a hoist assembly comprising a hoist winch and an associated hoisting cable, the hoisting cable extending from the hoist winch to the object suspension device, such that upon actuation of the hoist winch the object suspension device can be raised and lowered; wherein forked inner end of the secondary jib allows to receive the hoisting cable between the left-hand and right-hand fork ends on the jib axle;
- a secondary jib positioning device arranged between the secondary jib and the crane housing, adapted to support and position the secondary jib with respect to the main jib and actuate the pivotal movement of the secondary jib; the secondary jib positioning device comprising:
  - a secondary jib positioning winch cooperating with a secondary jib positioning cable, which cable extends between the crane housing and a tension chain;
  - a spoke structure fixed to the secondary jib and extending radially outward from the jib axle, comprising one or more right-hand spokes attached to the right-hand fork end of the secondary jib and one or more left-hand spokes attached to the left-hand fork end of the secondary jib, wherein between the right-hand spokes and the left-hand spokes a space is defined through which the hoisting cable extends; wherein the length of the forked outer ends of the main jib is such that the gap between the forked outer ends of the main jib allows to pass at least a portion of the spoke structure;
  - a tension chain connected at one end to the secondary jib positioning cable and at the other end to the secondary jib and/or to the spoke structure, the spoke structure being adapted to support the tension chain.

The secondary jib positioning device supports and positions the secondary jib with respect to the main jib, and accurately controls the pivotal movement of the secondary jib at a range of different positions with respect to the main jib: from an extended position in which the tip extends mainly forward from the main jib, to a folded position in which the secondary jib is folded back.

The provision of a secondary jib positioning device according to the invention allows a vast range of positions of the secondary jib, using simple means such as cables and a winch. Consequently, the design options for the dimensions of the main jib and the secondary jib are no longer limited by the restrictions inherent to the use of a cylinder between them: smaller cross-sections of the main jib and secondary jib are possible, and a wider variety of mutual dimensions. In particular, a double jib slewing pedestal crane design according to the invention is possible having a capacity of several hundred tons, even up to 1000 tons.

As indicated above, the double jib slewing pedestal crane according to the invention is in particular advantageous on a vessel. However, the design of the double jib slewing pedestal crane of the invention is such that it is the stationary pedestal is not only adapted to be mounted to a vessel, but is also suitable to be mounted on land, for land-based cranes, or to a vehicle for mobile cranes, such as known from WO2005/030632 from the same applicant.

The double jib slewing pedestal crane according to the present invention comprises a stationary pedestal, preferably adapted to be mounted to, or formed integral with a vessel. In particular, the pedestal is preferably mounted on deck of the vessel, but it is also conceivable that the pedestal is formed integral with a portion of the hull and possibly the deck of the vessel, which may improve the overall stability of the crane.

According to the invention, a crane housing is mounted to the pedestal and adapted to slew, i.e. rotate, relative to the pedestal about a vertical slew axis, e.g. via a rotating bearing. As such, rotation of the main jib and secondary jib in a horizontal plane is allowed, to have a large reach area of the crane. The advantage of pedestal mounted crane is the radial flexibility of the crane. The crane housing is of an elongated essentially vertical construction. In embodiments, the crane housing may include an angle with the vertical axis, e.g. of 10°, but up to 30° is also conceivable. Possibly, the cross-section of the crane housing is circular, but square or polygonal cross-sections are also possible. In an embodiment, the crane housing tapers towards the top, away from the pedestal. Preferably, the crane housing is of a hollow construction allowing one or more cables to pass through the crane housing, and the crane housing is provided with a top allowing the one or more cables to exit the crane housing. Advantageously, major components of the crane may be installed inside the crane housing, well protected from the harsh marine environment. In an embodiment, rotating parts of the crane are provided with totally enclosed slew bearings and therefore maintenance is limited.

An operators cabin is preferably connected to the outside of the crane housing. In addition, provisions for heave compensation, preferably active heave compensation, may also be provided on the crane housing.

The main jib is connected to the crane housing, preferably to a lower portion of the crane housing, relatively close to the pedestal. The first horizontal pivot axis may extend adjacent the crane housing, but configurations wherein the pivot axis extend through the crane housing are likewise conceivable, such as e.g. disclosed in WO2008088213 of the same applicant.

According to the invention, the main jib comprises forked outer ends between which the jib axle extends. In a possible embodiment, the main jib also comprises forked inner ends, pivotably connected to the crane housing. In the space created between the forked inner ends, winches may be provided, e.g. a hoist winch, and/or an operators cabin and/or provisions for heave compensation.

Preferably, the central and forked ends of the main jib are essentially embodied as box girders, forming an enclosed tube with surrounding walls. In an embodiment, the surrounding walls are of an open trussed or latticed configuration. Alternatively, the surrounding walls may form a closed hollow casing. Yet alternatively, hybrid configuration are also conceivable, comprising both hollow casings and trussed connections therebetween. The forked ends may be tapering towards the ends, e.g. such that the space between the forked ends increases towards the ends.

The pivot connection between the main jib and the crane housing allows an up-and-down luffing movement of the main jib. A luffing assembly is provided to support and control the position of the main jib relative to the crane housing. The luffing assembly extends between the main jib and the crane housing, and comprises a luffing cable and a luffing winch. In an embodiment, the luffing cable extends to an outer end of the main jib. The luffing cable may also extend to a portion of the main jib at a distance from the outer end. In an embodiment, the luffing winch is provided within the rotating crane housing of the crane, and the luffing cable extends through the crane housing. Alternatively, the luffing winch may be provided adjacent or even connected to outside of the crane housing. Hence, the luffing winch is rotatable with the crane housing. In an embodiment, the luffing cable extends from a top part of the crane housing, but alternatively, it is also conceivable that the hoisting cable extends from a central or lower part of the crane housing.

It is noted that the use of a luffing assembly to position the main jib is known from, and similar to conventional cranes having a single boom or jib. Varying the length of the luffing cable allows a pivoting movement of the main jib, essentially between a downwardly pointed direction and a raised vertical position, i.e. generally between 0° (vertical) and 135° (pointing downwards). Depending on the geometry of the crane housing, the main jib may be allowed to pivot even slightly beyond vertical. Depending on the position of the first pivot axis, the downwardly pointed position may include an angle of only 90° or even close to 180° (when the first pivot axis is at an elevated position, and it is possible for the main jib to extend downward essentially in line with the crane housing).

The main jib comprises opposed of the inner end two forked outer ends between which a jib axle extends, defining a second horizontal pivot axis. The forked outer ends may have a constant mutual distance, but it is also conceivable that the mutual distance increases or changes towards the end.

The double jib slewing pedestal crane furthermore comprises a secondary jib. This jib is also preferably embodied as box girder, forming an enclosed tube with surrounding walls. In an embodiment, the surrounding walls are of an open trussed or latticed configuration. Alternatively, the surrounding walls may form a closed hollow casing. Yet alternatively, hybrid configuration are also conceivable, comprising both hollow casings and trussed connections therebetween. The forked ends may be tapering towards the ends, e.g. such that the space between the forked ends increases towards the ends.

The secondary jib of the inventions comprises a forked inner end defining a left-hand fork end and a right-hand fork end, which are connected pivotably to the jib axle, allowing a pivotal movement of the secondary jib with respect to the main jib. Left and right are here defined as when seen from the direction of the crane housing, along the main jib towards the secondary jib.

Preferably, the forked inner end of the secondary jib is connected between the forked outer ends of the main jib. Alternatively, it is conceivable that the forked outer ends of the main jib taper towards each other at the end, allowing them to be connected between the left-hand fork end and the right-hand fork end of the secondary jib.

The double jib stewing pedestal crane is furthermore provided with an object suspension device to which an object is connectable, such as a hook, and a hoist assembly. The hoist assembly comprises a hoist winch and an associated hoisting cable. In an embodiment, the hoist winch is provided in or below the pedestal of the crane, and the hoisting cable extends through the crane housing. Alternatively, the hoist winch may be provided adjacent or even connected to the crane housing. Winches for ultra deep lifts require a large storage capacity and may in an embodiment be fitted outside the crane housing. In an embodiment, the hoisting cable extends from a central part of the crane housing, but alternatively, it is also conceivable that the hoisting cable extends from an upper or lower part of the crane housing.

In a double jib crane of the invention, the hoisting cable extends from the winch to the object suspension device, such that upon actuation of the winch the object suspension device can be raised and lowered. Preferably, the hoisting cable extends via a guide sheave provided centrally on the jib axle. The forked inner end of the secondary jib allows to receive the hoisting cable centrally between the left-hand and right-hand fork ends on the jib axle. In an embodiment, a departing sheave for the hoisting cable is provided on the secondary jib. The departing sheave is preferably provided at an outer end of the secondary jib, but configurations are possible wherein the departing sheave may also be provided at a distance from the outer end of the secondary jib. Optionally, a dead end of the hoisting cable is connected to the outer end of the secondary jib.

The double jib stewing pedestal crane of the invention comprises a secondary jib positioning device arranged between the secondary jib and the crane housing, adapted to support and position the secondary jib with respect to the main jib and actuate the pivotal movement of the secondary jib.

The secondary jib positioning device comprises a secondary jib positioning winch cooperating with a secondary jib positioning cable, which cable extends between the crane housing and a tension chain. In an embodiment, the secondary jib positioning winch is provided in the crane housing, and the secondary jib positioning cable extends through the crane housing. Hence, the secondary jib positioning winch is rotatable with the crane housing. Alternatively, the secondary positioning winch may be provided adjacent or even connected to the crane housing. In an embodiment, the secondary positioning cable extends from a central part of the crane housing, but alternatively, it is also conceivable that the secondary positioning cable extends from an upper or lower part of the crane housing.

It is advantageous for the interplay of forces when the luffing cable and the secondary jib positioning cable are not provided in parallel. Thus, the provision of an elongated crane housing allows a configuration in which the luffing cable extends between the outer end of the main jib and an upper end of the crane housing, to extend in a direction relatively close to the horizontal direction. The secondary jib positioning cable may be allowed to extend between the tension chain and a lower portion of the crane housing closer to the pedestal, to extend in a direction relatively closer to the vertical direction. As such, the luffing cable and the secondary jib positioning cable extend at an angle with respect to each other, which is advantageous for the interplay of forces. Preferably, the angle between the luffing cable and the secondary jib positioning cable is at least 40°.

Alternatively, the pedestal can be embodied as a fixed mast, wherein the crane housing is embodied as a rotating slew platform supporting the main jib, and a mast head at the top of the mast. The hoisting cable is allowed to run from the mast head or the rotating slew platform to the tip of the secondary jib. Also the luffing cable is allowed to run from the mast head to the main jib, to control the position of the main jib. Possibly also the secondary jib positioning cable is allowed to run from the mast head to the tension chain to control the position of the secondary jib. This allows the different hoists to be positioned at the preferred radius. The mast construction gives an inherent safety feature; the load moment is carried by the mast and not by the slew bearings.

The secondary jib positioning device further comprises a spoke structure fixed to the secondary jib and extending radially outward from the jib axle. The spoke structure comprises one or more right-hand spokes attached to the right-hand fork end of the secondary jib and one or more left-hand spokes attached to the left-hand fork end of the secondary jib. The spokes can be embodied as rods, profiled beams, plates, etc. Furthermore, plates or trusses or the like may be provided between the spokes. Advantageously, the spoke structure extends essentially in a quarter of a circle, defined between the upward perpendicular direction with respect to the secondary jib, and a direction essentially opposite the secondary jib. In this quarter, the spoke structure can optimally attribute to supporting, positioning and manipulating the secondary jib.

The secondary jib positioning device comprises in addition to the secondary jib positioning winch, secondary jib positioning cable and spoke structure a tension chain, which is connected at one end to the secondary jib positioning cable and at the other end to the secondary jib and/or to the spoke structure, the spoke structure being adapted to support at least a portion of the tension chain. In an embodiment, the tension chain is formed integral with the secondary positioning cable.

In operation, the secondary jib positioning winch is actuated to haul in and expel the secondary jib positioning cable, which is connected to the tension chain which in turn is connected to the secondary jib, optionally via a spoke structure that is fixed to the secondary jib. The spoke structure enables a variety of angular positions of the secondary jib with respect to the main jib.

The tension chain is for example embodied as a series of interconnected links, such as elongated rods, and/or cable portions or other elements. The spoke structure is adapted to support the tension chain, possibly a link of the tension chain. To that end, the radial outer end of the spoke structure is preferably provided with one or more seats. In a possible embodiment, wherein the tension chain comprises elongated rods interconnected via pivots, the pivots between the elongated rods are adapted to be supported by the spoke structure, for example by the seat provided at the distal end of a spoke. An advantage of such an embodiment is that slip of the tension chain over the spoke structure is not possible. In a possible embodiment, the spoke structure is provided with a groove in which the tension chain is supported. Alternatively, the spoke structure may be provided with protrusions which may cooperate with indentations in the tension chain, e.g. within a link.

According to the invention, the tension chain extends between the secondary jib positioning cable and the spoke structure, or between the secondary jib positioning cable and the secondary jib.

The spoke structure comprises one or more right-hand spokes attached to the right-hand fork end of the secondary jib and one or more left-hand spokes attached to the left-hand fork end of the secondary jib, wherein between the right-hand spokes and the left-hand spokes a space is defined through which the hoisting cable extends.

In an embodiment, the spoke structure comprises a first spoke fixed essentially perpendicular to the secondary jib, e.g. including a first angle of 70-110°. In an embodiment, a tension link is provided between the radial outer end of the first spoke and the outer end of the secondary jib. In an embodiment, the first spoke is provided adjacent the jib axle, and has a forked inner end to receive the guide sheave. Alternatively, it is conceivable that the first spoke is provided at a distance from the jib axle.

In an embodiment, a left-hand spoke and a right-hand spoke of the spoke structure form parallel second spokes, including a second angle with respect to the secondary jib. The second angle e.g. is between 70-200°, preferably between 110-160°. Between these parallel second spokes a space is defined through which the hoisting cable extends. Alternatively, the left-hand and right-hand spokes of the spoke structure may be embodied as plates, or comprise a number of possibly interconnected spokes.

In an embodiment, the spoke structure comprises a further left-hand and a further right-hand spoke forming parallel third spokes, including a third angle with respect to the secondary jib. This third angle is larger than the first and second angle, i.e., between 130-200°, in particular between 160-180°. Possibly, the second and third spokes are interconnected at intermediate portions of the spokes via struts. This provides strength to the spoke structure, as the left-hand and right-hand spokes cannot be interconnected in the space defined between the members, as the hoisting cable should be able to extend therethrough.

As indicated before, the main jib has forked ends. According to the invention, the length of the forked ends of the main jib is such that the gap between the forked ends of the main jib allows to pass at least a portion of the spoke structure. In operation, the spoke structure is fixed to the secondary jib and rotatable with the secondary jib. The spoke structure extends radially outward from the jib axle, preferably essentially in a quarter of a circle, defined between the upward perpendicular direction with respect to the secondary jib, and a direction essentially opposite the secondary jib. Hence, the spoke structure extends essentially opposite in line with the secondary jib, which coincides with the position of the main jib when the secondary jib is positioned forwardly in line with the main jib. To enable the secondary jib to rotate further with respect to the main jib, it is desirable that at least a portion of the spoke structure is allowed to pass the main jib. The forked end of the main jib creates a gap between the forked ends, through which gap at least a portion of the spoke structure can pass. Hence, rotation about the jib axle of the secondary jib with the spoke structure attached to it is possible over a vast range, enabled by the gap in the main structure allowing a portion of the spoke structure to pass.

When the main jib is in an upright, vertical position, the secondary jib can be raised to the vertical position in which the tip extends upwardly. Preferably, the main jib, on the side of the spoke structure, is provided with a stop, e.g. a cylinder, that contacts the secondary jib when it is in its vertical position and prevents the secondary jib from falling over backwards.

When the main jib is in an upright, vertical position, the secondary jib can also be lowered 180° to a vertical position in which the tip extends downwardly, and in which the secondary jib is folded back, essentially parallel along the main jib.

In a possible embodiment, a yang is provided between the main jib and the secondary jib to position and/or fixate the position of the secondary jib with respect to the main jib. Possibly, the yang is connected to a central area of the main jib and to a central area of the secondary jib. The secondary jib positioning cable, together with the spoke structure, is able to lower and raise the secondary jib with respect to the main jib.

In a situation in which the main jib is positioned horizontally, the secondary jib positioning cable and spoke structure are able to pull the secondary jib upwards to a vertical position in which the tip extends upwards, and to lower the secondary jib until the tip of the secondary jib extends downwards. However, in this situation the secondary jib positioning cable is not able to pivot the secondary jib further to the folded position in which the secondary jib is folded back along the main jib. In this situation the provision of a yang is advantageous, as such a yang is able to pull the secondary jib towards the main jib to a folded position. Thus, the yang is used to allow even more relative positions of the secondary jib and main jib.

Another advantage of a yang is that it may contribute to the fixation of the secondary jib relative to the main jib. In a general configuration, the secondary jib is prevented from lowering by the secondary jib positioning cable. The secondary jib is prevented to move upwards by gravity, not only exerted on the secondary jib itself but also on a load which is possibly suspended from the hoisting cable. However, due to sea state induced vessel motions, gravity, in particular when only exerted on the secondary jib alone, may be insufficient to prevent small upward movements of the secondary jib. The provision of a yang will fixate the secondary jib relative to the yang.

According to a second aspect of the invention, a double jib slewing pedestal crane is provided, comprising:

- a stationary pedestal, preferably adapted to be mounted to a vessel;
- a crane housing that is mounted to the pedestal and adapted to slew relative to the pedestal about a vertical slew axis;
- a main jib comprising an outer end and an opposed inner end which is connected pivotably about a first horizontal pivot axis to the crane housing, allowing an up-and-down luffing movement of the main jib;
- a luffing assembly comprising a luffing winch and a luffing cable extending between the main jib and the crane housing; and
- a secondary jib comprising an outer end and an opposed inner end connected pivotably about a second horizontal pivot axis to the outer end of the main jib, allowing a pivotal movement of the secondary jib with respect to the main jib;
- an object suspension device to which an object is connectable;
- a hoist assembly comprising a hoist winch and an associated hoisting cable, wherein the secondary jib is provided with a hoist cable departing sheave at the outer end and a first mounting facility for a hoist cable retention device close to the inner end, allowing the hoisting cable to extend from the winch, via the departing sheave and via the object suspension device to a hoist cable retention device, such that the hoisting cable comprises one or more first suspension cable parts extending between the object suspension device and the departing sheave, and one or more second suspension cable parts extending between the object suspension cable device and the hoist cable retention device, such that the first and second suspension cable parts extend at an angle with respect to each other when the hoist cable retention device is mounted at the first mounting facility.

Optionally, a secondary jib positioning device according to the first aspect of the invention is provided. The second aspect of the invention is differs from known double jib slewing pedestal cranes in that a second mounting facility for a hoist cable retention device is provided between the inner and the outer end, such that the first and second suspension cable parts extend at a relatively large angle with respect to each other when the hoist cable retention device is mounted at the first mounting facility, and at a relatively small angle with respect to each other when the hoist cable retention device is mounted at the second mounting facility.

The angle between the suspension cable parts prevents entanglement of the cables, a phenomenon also referred to as rope or wire twisting.

In an embodiment, the mounting facility for a hoist cable retention device is embodied as a set of holes provided in the secondary jib. For example, the secondary jib may comprise top, bottom and side walls, wherein a bottom part of the side walls is provided with one or more holes.

The hoisting cable extending from the hoist winch may have a dead end or an end connected to another winch. It is conceivable that two winches are provided, and that the hoisting cable extends from one winch, via a guide sheave, departing sheave, and object suspension device, via the retention device to the second hoist winch. Alternatively, the hoist cable has a dead end, connected to a dead end connection point. This point may be provided anywhere on the main or secondary jib, the crane housing or elsewhere. In an embodiment, the hoist cable retention devices is embodied as the dead end connection point. As such, the hoisting cable extends from the winch, via a guide sheave and the departing sheave, via the object suspension device to the hoist cable retention device, and is connected thereto.

The invention is further elucidated in the attached drawings, in which:

In FIGS. 1-7 various positions and details of a double jib slewing pedestal crane according to both aspects of the present invention are shown. As all drawings relate to the same embodiment, the same reference numbers are used in all figures.

Figure 1:
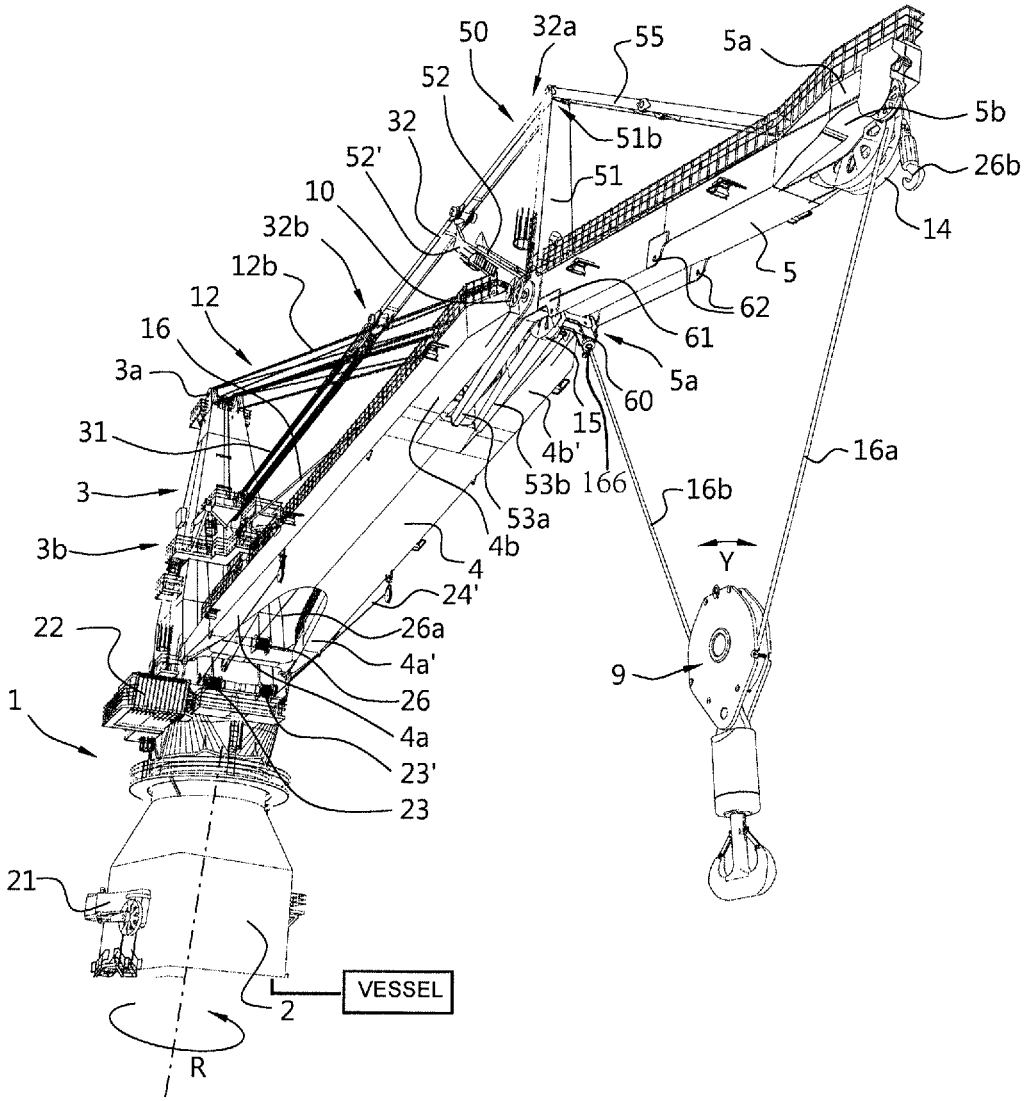
FIG. 1 shows a perspective view of a double jib slewing pedestal crane according to the present invention, wherein the secondary jib is positioned essentially in line with the main jib.
Figure 2:
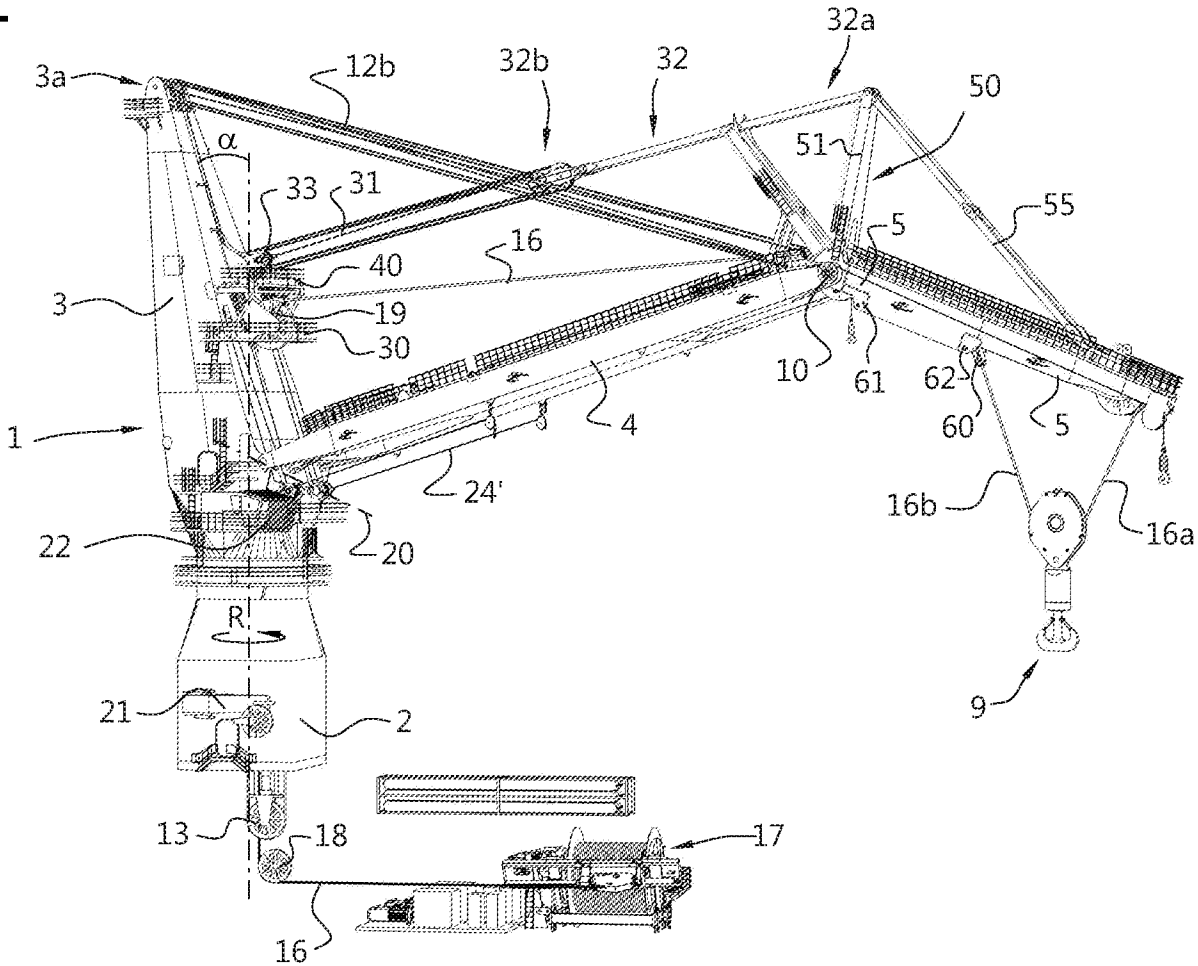
FIG. 2 shows a perspective view of the double jib slewing pedestal crane of FIG. 1, wherein the secondary jib includes a sharp angle with the main jib.

A double jib slewing pedestal crane 1 is shown in its entirety in FIGS. 1, 2, 6 and 7. The double jib slewing pedestal crane 1 according to both aspects of the invention comprises a stationary pedestal 2 which is adapted to be mounted to a vessel. On the pedestal 2, a hoisting cable guide 21 is provided, described in pending application NL 2009287.

A crane housing 3 is mounted to the pedestal 2 and adapted to slew relative to the pedestal 2 about a vertical slew axis R. The crane housing 3 of this embodiment is shaped as a closed vertical column tapering towards the top. The central axis of the crane housing 3 extends at a small angle $\alpha$ of about 20° with respect to the vertical as visible in FIG. 2, to give room to the main jib 4. On the crane housing 3, an operator's cabin 22 is provided.

Attached to a lower portion of the crane housing 3 is the inner end of a main jib 4, which is connected pivotably about a first horizontal pivot axis 20 to the crane housing 3. The main jib 4 is here of a closed configuration, essentially box-shaped, including forked inner ends 4*a* and 4*a*', shown in detail in FIG. 3, and forked outer ends 4*b* and 4*b*', shown in detail in FIGS. 4 and 5. The main jib and the secondary jib may be of any possible configuration, e.g. one of them or both may have a truss-shaped framework, but alternatively it is also conceivable that one of them or both are formed as a closed box.

In order to position the main jib 4, a luffing assembly 12 is provided, extending between the outer end 4*b*, 4*b*' of the main jib 4, here in particular in the vicinity of the second pivot axis 11, and the crane housing 3, here an upper end 3*a* of the crane housing. The luffing assembly 12 comprises a luffing winch (not visible) and a luffing cable 12*b*. In particular in FIG. 4 it is visible that two parallel sets of luffing cable 12*b* extend to the outer end 4*b* and the outer end 4*b*' of the main jib respectively. The luffing winch is preferably provided inside the crane housing.

Between and slightly below the forked inner ends 4*a* and 4*a*' winches are mounted to the crane housing 3, in particular damping winches 23 and 23' to which damping cables 24 and 24' are connected, respectively. These damping devices comprising winches and cables may be connected to the object suspension device 9, to dampen sea-state induced motions of the object suspension device 9.

Furthermore, a winch 26 is provided, which actuates hoist cable 26*a* which is connected to a hook 26*b*. This assembly is e.g. provided for additional hoisting capacity, but can alternatively also be provided to assist in motion-compensation.

Figure 7:
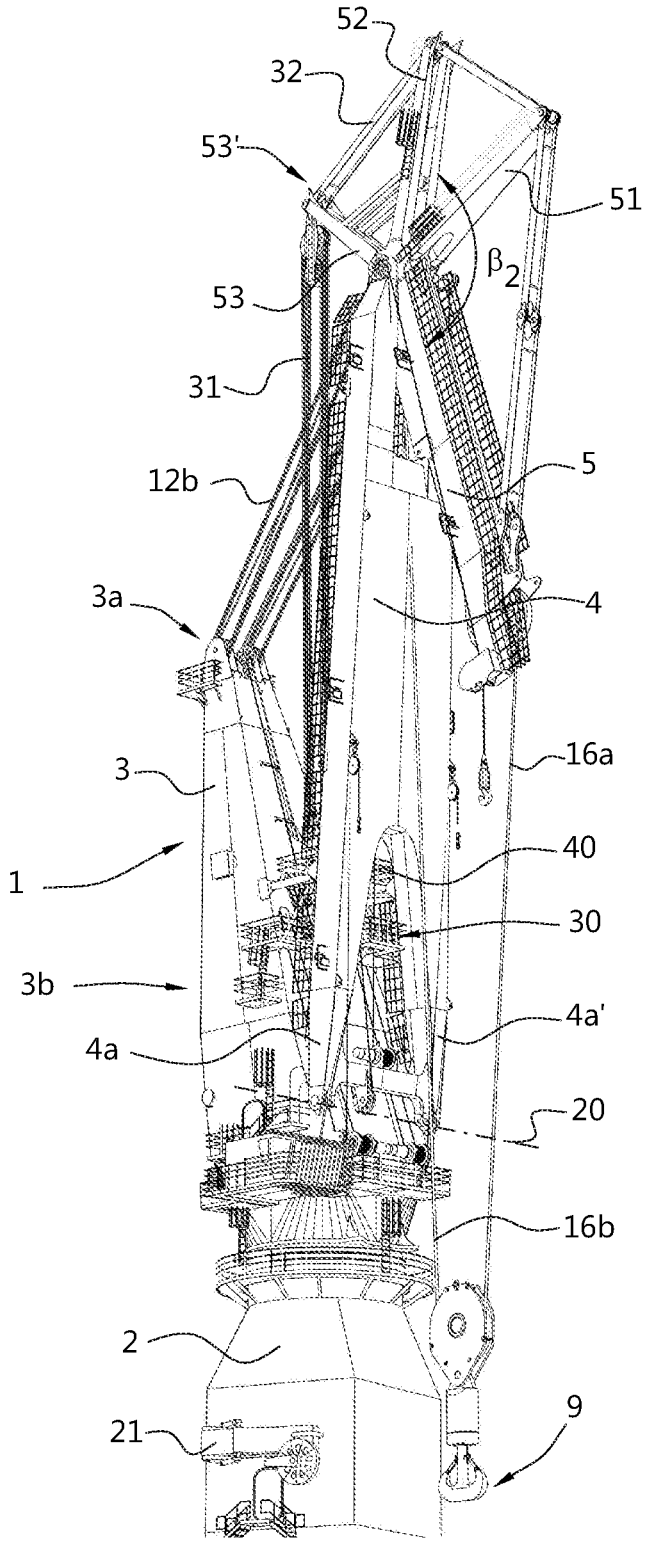
FIG. 7 shows a perspective view of the double jib slewing pedestal crane of FIG. 1, wherein the secondary jib includes an even sharper angle with the main jib than shown in FIG. 6.

The advantage of the forked inner ends 4*a* and 4*a*' is in particular visible in FIG. 7, in which it is visible that two platforms 30 and 40 mounted on a central part 3*b* of the crane housing protrude between the forked inner ends 4*a* and 4*a*'. The functions of these platforms 30, 40 will be explained later.

Figure 4:
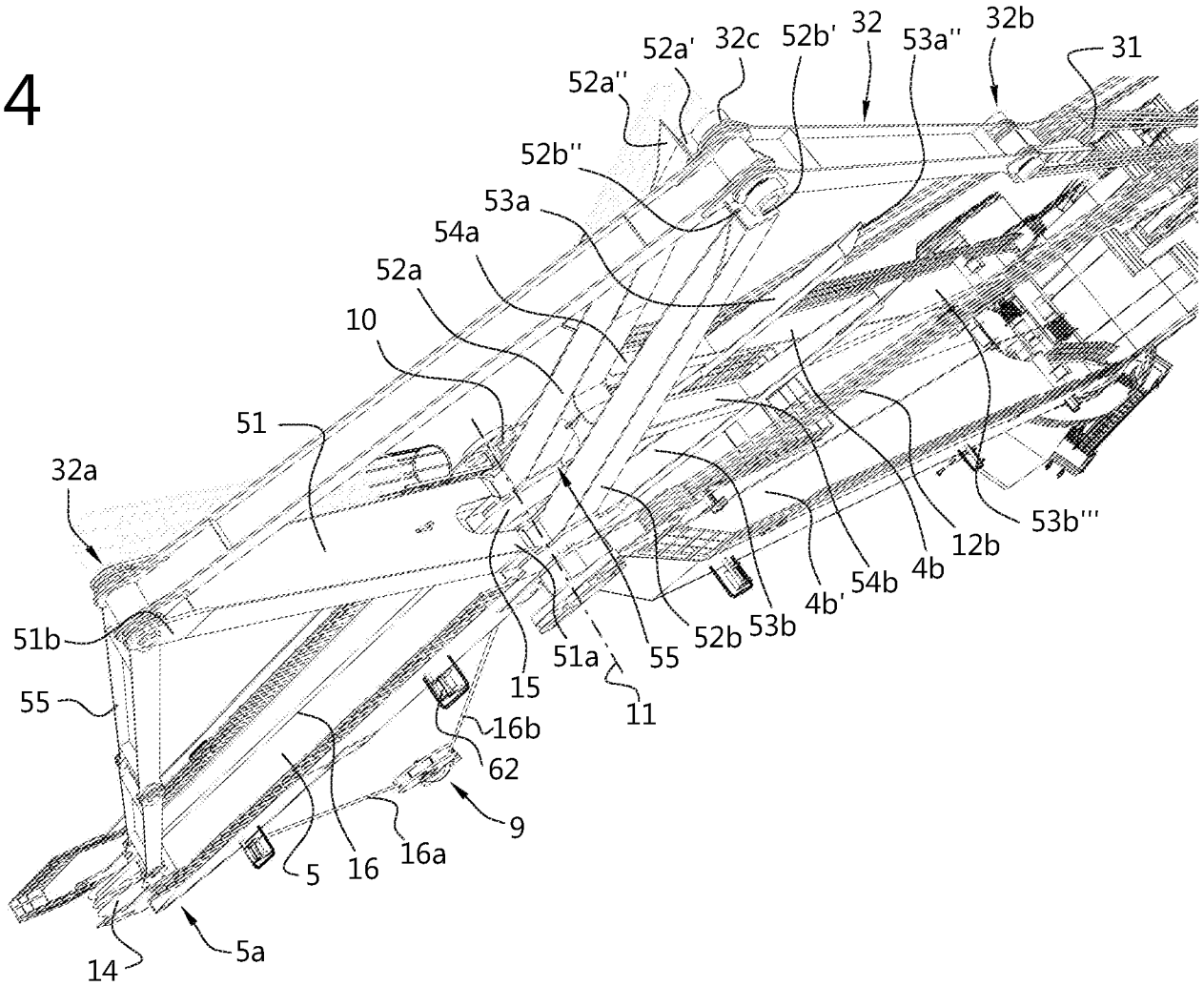
FIG. 4 shows a perspective top view of a detail of the double jib slewing pedestal crane in the position of FIG. 1.

Between the two forked outer ends 4*b* and 4*b*' a jib axle 10 extends defining a second horizontal pivot axis 11, indicated in FIG. 4.

A secondary jib 5 is provided, comprising a forked inner end defining a left-hand fork end 5*b*' and a right-hand fork end 5*b*, which are connected pivotably to the jib axle 10. In particular, in the shown embodiment, the forked inner end of the secondary jib is connected to the jib axle 10 between the forked outer ends 4*b* and 4*b*' of the main jib. The pivot connection of the secondary jib 5 allows a pivotal movement of the secondary jib 5 with respect to the main jib 4. The secondary jib 5 of the shown embodiment is also of a closed box-shaped configuration, similar to that of the main jib 4. Between the left-hand fork end 5*b*' and the right-hand fork ends 5*b* of the secondary jib 5 a guide sheave 15 for a hoisting cable 16 is received on the jib axle 10. This will be explained in more detail below.

Figure 3:
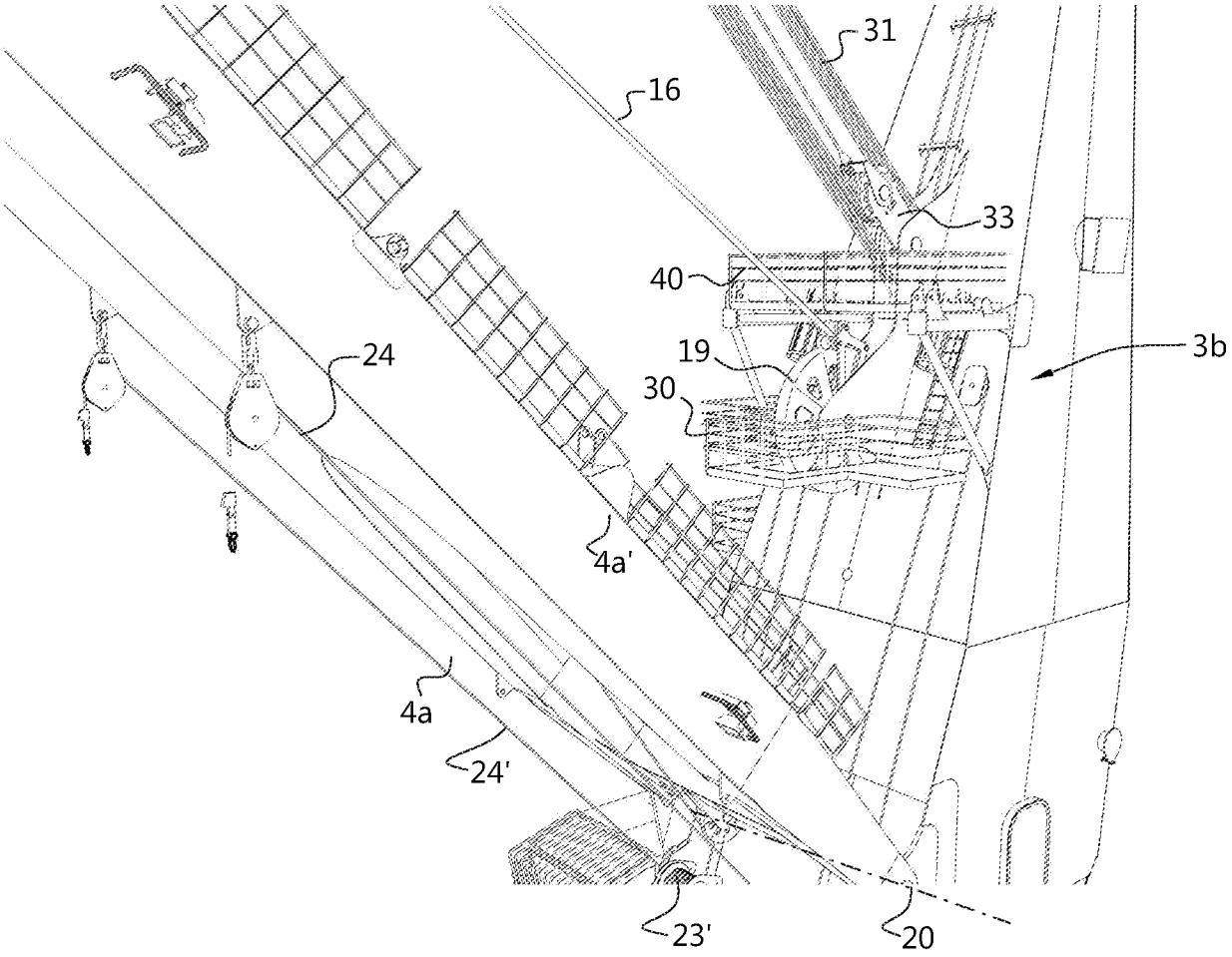
FIG. 3 shows a detail of the crane housing and hoisting cable of the double jib slewing pedestal crane of FIG. 1.

The double jib slewing pedestal crane 1 further comprises a hoist assembly comprising a hoist traction winch, provided within the pedestal 2 and not visible here, extending to a hoist wire storage winch 17 which is in the shown embodiment is provided below the pedestal 2, preferably below deck in the hull of a vessel (not shown). From the hoist wire storage winch 17 a hoisting cable 16 extends, which extends via a sheave 18 provided below the pedestal 2 into the crane housing 3. Heave compensation is indicated with reference number 13. Via a sheave 19 mounted onto the crane housing 3 the hoisting cable 16 extends to the jib axle 10, where guide sheave 15 is provided. Sheave 19, in detail shown in FIG. 3, is surrounded by a platform 30, which, in an upright position of the main jib 4, falls between the forked inner ends 4*a*, 4*a*' of the main jib. From guide sheave 15, the hoisting cable 16 extends over the secondary jib 5 via a departure sheave 14 on the secondary jib 5, in particular provided at the outer end 5*a* of the secondary jib, to an object suspension device 9. From FIGS. 4 and 5 it is visible that the outer end 5*a* of the secondary jib 5 is also forked, as the departure sheave 14 of the shown embodiment is provided between these forked outer ends. Other configurations are also conceivable. The position of sheave 19 halfway the crane housing 3 is advantageous as it causes the hoist cable to enter the crane housing in the axis of rotation R of the crane housing, enabling the crane housing to slew without causing the hoisting cable to entangle or get twisted.

In order to position the secondary jib 5 with respect to the main jib 4, according to the first aspect of the invention a secondary jib positioning winch (not shown) cooperating with a secondary jib positioning cable 31 is provided, extending between the crane housing 3 and a tension chain 32. The secondary jib positioning winch is preferably positioned inside the crane housing. In the shown embodiment the secondary jib positioning cable 31 departs the crane housing at a central part 3*b* thereof, in particular via a sheave block 33 provided in a central part 3*b* of the crane housing 3. In the shown embodiment, as in particular visible in FIG. 3, a platform 40 is connected to the central part 3*b* of the crane housing adjacent the sheave block 33.

The shown secondary jib positioning cable 31 comprises a combination of cables and sheaves, which can be actuated via a winch (not shown) to vary in length.

The secondary jib positioning device of the first aspect of the invention further comprises a tension chain 32, embodied as a series of multiple articulated interconnected rods, one end of which is pivotably connected to the secondary jib positioning cable 31 about pivot 32*b*. Tension chain 32 is supported by a spoke structure 50, and extends to and is pivotably connected to this spoke structure 50 about pivot 32*a*.

The spoke structure 50 is fixed to the secondary jib 5 and extends radially outward from the jib axle 10, and is pivotable together with the secondary jib 5 about the second pivot axis 11. The spoke structure 50 of the shown embodiment comprises spokes 51, 52*a*, 52*b*, 53*a* and 53*b*, extending essentially in a quarter of a circle, defined between the upward perpendicular direction with respect to the secondary jib, and a direction essentially opposite the secondary jib. The spokes differ in length.

In the shown embodiment, first spoke 51 extends essentially in an upward perpendicular direction with respect to the secondary jib 5. In particular, spoke 51 includes a first angle β1, indicated in FIG. 6, with secondary jib 5. This angle β1 is preferably between 45-130°, more preferably between 70-110°, in particular between 80-100°.

Figure 6:
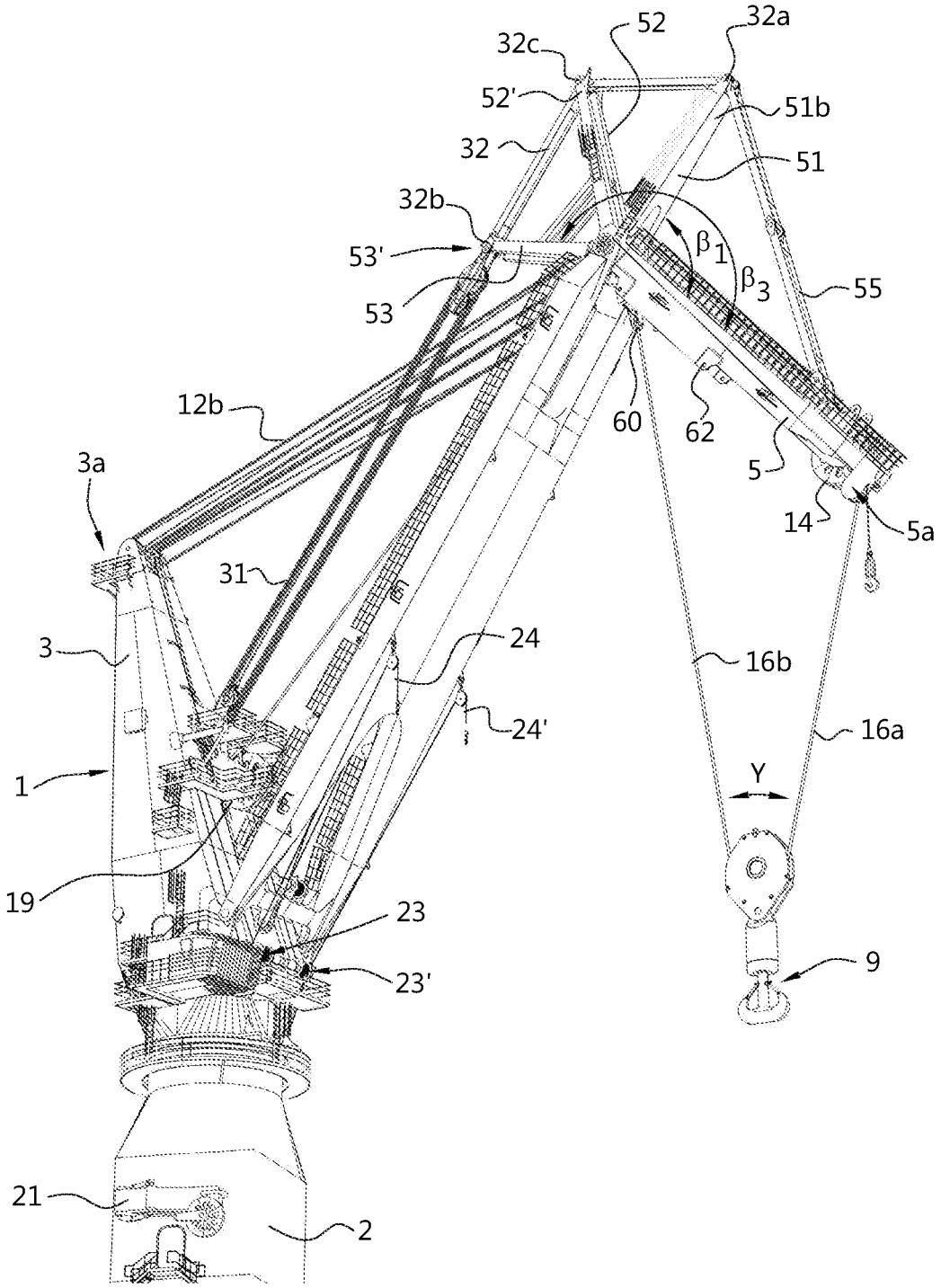
FIG. 6 shows a perspective view of the double jib slewing pedestal crane of FIG. 1, wherein the secondary jib includes an even sharper angle with the main jib than shown in FIG. 2.

Parallel right-hand third spoke 53*a* and left-hand third spoke 53*b* extend in a direction essentially opposite the secondary jib 5, and includes a third angle β3, indicated in FIG. 6, with secondary jib 5. This angle β3 is preferably between 160-210°.

Parallel right-hand and left-hand second spokes 52*a*, 52*b* are provided therebetween, and include a second angle β2, for clarity indicated not in FIG. 6 but in FIG. 7, with secondary jib 5. This second angle β2 is preferably between 110-180°, in particular between 130-160°.

The spokes 52, 53 of the spoke structure are composed of right-hand spokes 52*a*, 53*a*, attached to the right-hand fork end 5*b*, and left-hand spokes 52*b*, 53*b*, attached to the left-hand fork end 5*b*'. Between the right-hand spokes 52*a*, 53*a* and the left-hand spokes 52*b*, 53*b* a space 55 is defined, indicated in FIG. 4, in which the guide sheave 15 is provided and through which the hoisting cable 16 extends. The right-hand spokes 52*a*, 53*a* are mutually connected via a strut 54*a*. Likewise, the left-hand spokes 52*b*, 53*b* are mutually connected via a strut 54*b*.

In the shown embodiment, the first spoke 51 has a forked inner end 51*a*, wherein the hoisting cable 16 extends between the forked ends from the guide sheave 15 to the departing sheave 14. In an alternative configuration, it is not required to provide such a forked inner end 51*a*.

In the shown embodiment, the tension chain 32 is pivotably connected at one end via pivot 32*b* to the secondary jib positioning cable 31 and is connected at the other end via pivot 32*a* to the spoke structure 50, in particular to the radial outer end 51*b* of the first spoke 51. In addition, a tension link 55 is provided between the radial outer end 51*b* of the first spoke 51 and the outer end 5*a* of the secondary jib 5. This tension link 55 is embodied similar to the tension chain 32. As in the shown embodiment the tension chain 32 is connected to the radial outer end 51*b*, the tension link 55 is a different part of the construction. In an alternative embodiment, the tension chain 32 is not connected to the spoke structure, but to the outer end 5*a* of the jib. In this case, the tension chain 32 comprises a link similar to tension link 55, which in this embodiment is thus part of the tension chain. The tension chain 32 is supported by the spoke structure.

In the shown embodiment, the radial outer ends of the second spokes 52*a,b*, as visible in particular in FIG. 4, are provided with seats 52*a*' and 52*b*' for receiving a pivot 32*c* of the tension chain. Adjacent the seats, guide plates 52*a*" and 52*b*" are optionally provided to guide and position the pivot 32*c* correctly onto the seats. This is in particular advantageous as the tension chain 32 is inherently susceptible to play, and hence the exact position of the pivot 32*c* is variable. At the radial outer ends 53' of the third spokes 53*a,b* guide plates 53*a*" and 53*b*" for pivot 32*b* of the tension chain 32 are visible in FIG. 4.

In the position of the main boom 4 and jib 5 of FIGS. 6 and 7, wherein the main jib 4 and the secondary jib 5 include an acute angle, tension chain 32 is supported by the first, second and third spokes 51, 52*a,b* and 53*a,b*. In the position shown in FIGS. 2 and 4, wherein the main jib 4 and the secondary jib 5 include an obtuse angle, the tension chain 32 is no longer supported by the third spokes 53*a,b*. In the position shown in FIG. 1, wherein the main jib 4 and the secondary jib 5 extend almost in line with each other, it can be discerned that the tension chain 32 is no longer supported by the third spokes 53*a,b*, and not by the second spokes 52*a,b*.

Figure 5:
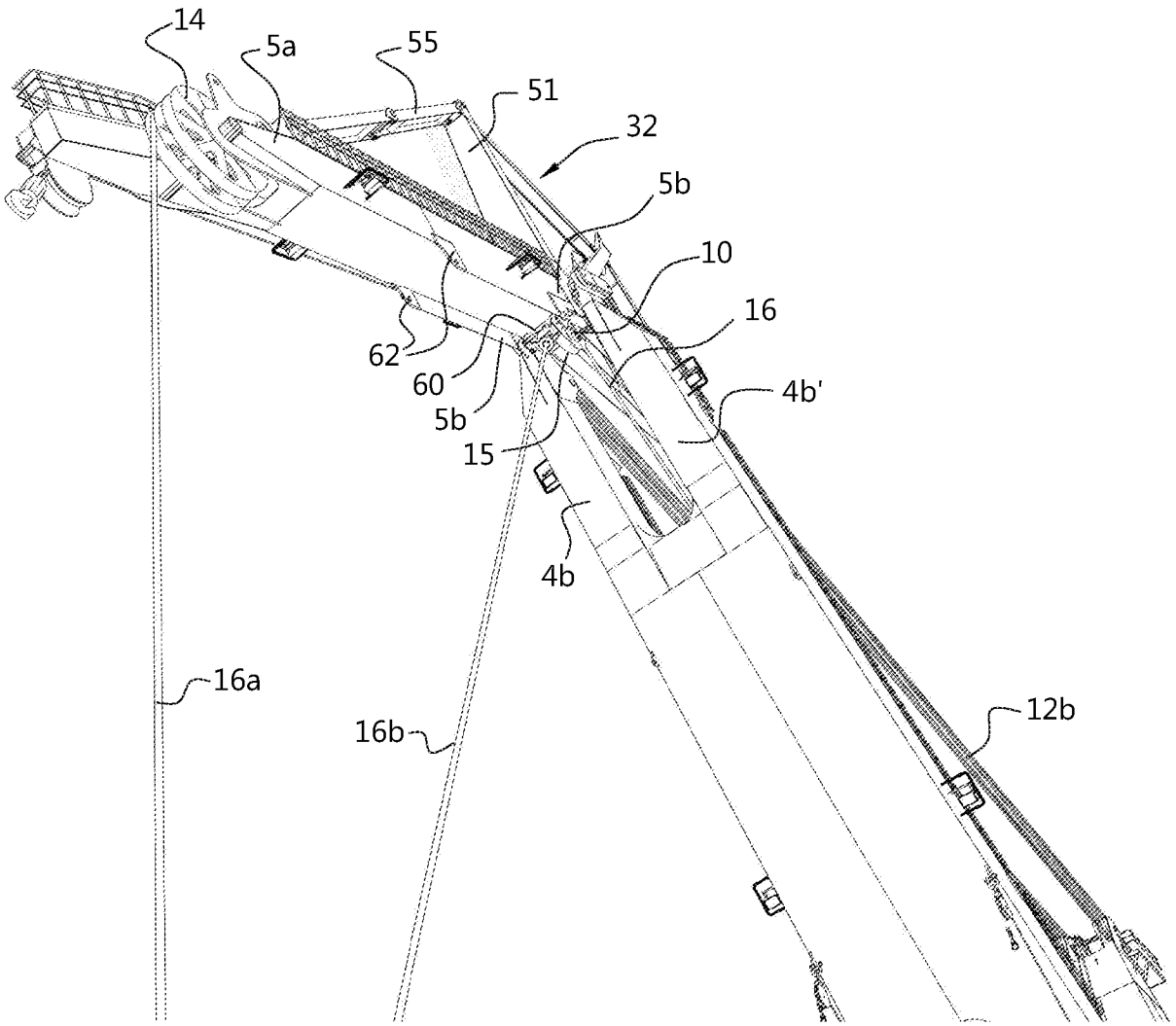
FIG. 5 shows a perspective view from below of a detail of the double jib slewing pedestal crane in the position of FIG. 1.

As indicated above, the main jib 4 has forked outer ends 4*b*, 4*b*', visible in detail in FIGS. 4 and 5. The length of these forked outer ends 4*b*, 4*b*' of the main jib 4 is such that the gap between the forked outer ends of the main jib allows to pass at least a portion of the spoke structure, in the shown embodiment at least the third right-hand spoke 53*a* and third left-hand spoke 53*b*. This passing through is visible in particular in FIG. 1.

The combination of secondary jib positioning cable 31, tension chain 32 and spoke structure 50 enables an accurate control of the position of the secondary jib 5 at a range of different positions with respect to the main jib 4: from an extended position in which the tip of the secondary extends mainly forward from the main jib, as visible in FIG. 1, to a folded position in which the secondary jib is folded back, essentially parallel along the main jib, as is visible in FIGS. 6 and 7.

In the drawings, also the second aspect of the invention is also visible. It is noted that the secondary jib positioning device of the first aspect of the invention is not required for the second aspect of the invention.

According to this second aspect of the invention, the secondary jib 5 is provided with a hoist cable departing sheave 14 at the outer end 5*a* and a first mounting facility 61 for a hoist cable retention device 60 close to the inner end 5*a* and a second mounting facility 62 for a hoist cable retention device 60 intermediate, here half-way, between the inner end 5*b* and the outer end 5*a*.

In the shown embodiment, the hoisting cable 16 extends from the hoist winch 17, via the departing sheave 14 and via the object suspension device 9 to a hoist cable retention device 60, such that the hoisting cable 16 comprises one or more first suspension cable parts 16*a* extending between the object suspension device 9 and the departing sheave 14, and one or more second suspension cable parts 16*b* extending between the object suspension cable device 9 and the hoist cable retention device 60. The first and second suspension cable parts 16*a*, 16*b* may extend at a relatively large angle γ with respect to each other when the hoist cable retention device is mounted at the first mounting facility 61, as visible in FIGS. 1, 4 and 5, and at a relatively small angle with respect to each other when the hoist cable retention device 60 is mounted at the second mounting facility 62, as visible in FIG. 2. This angle γ is not only determined by the mounting location of the hoist cable retention device 60, but also by the position of the object suspension device 9. Hence, although the angle may be relatively small when the hoist cable retention device 60 is mounted to the second mounting facility 62, compared to when it would be mounted to the first mounting facility 61, the angle γ may still be large as visible in FIG. 2. On the other hand, the angle γ will be small when the hoist cable retention device 60 is mounted to the first mounting facility 61, when the object suspension device 9 is lowered into the water, in particular deep water.

In the shown embodiment, the mounting facilities are embodied as holes, provided in plates that form part of the secondary jib 5. These plates extend beyond the cross-sectional area of the jib, and are provided solely for the purpose of the mounting facility.

The hoist cable retention device in the shown embodiment is a dead end connector. As shown in FIG. 1, the dead end 166 of the hoisting cable 16 is connected to the hoist cable retention device 60. Alternatively, the hoist cable retention device could also be embodied as a guide sheave.

The invention claimed is:

1. A double jib slewing pedestal crane comprising:

a stationary pedestal;

a crane housing that is mounted to the pedestal and adapted to slew relative to the pedestal about a vertical slew axis;

a main jib comprising an outer end and an opposed inner end which is connected pivotably about a first horizontal pivot axis to the crane housing, allowing an up-and-down luffing movement of the main jib;

a luffing assembly comprising a luffing cable extending between the main jib and the crane housing; and a secondary jib comprising an outer end and an opposed inner end connected pivotably about a second horizontal pivot axis to the outer end of the main jib, allowing a pivotal movement of the secondary jib with respect to the main jib;

an object suspension device to which an object is connectable;

a hoist assembly comprising a hoist winch and an associated hoisting cable;

wherein the secondary jib is provided with a hoist cable departing sheave at the outer end and a first mounting facility for a hoist cable retention device close to the inner end of the secondary jib and a second mounting facility for the hoist cable retention device between the inner end of the secondary jib and the outer end of the secondary jib, allowing the hoisting cable to extend from the hoist winch, via the departing sheave and via the object suspension device to the hoist cable retention device, such that the hoisting cable comprises one or more first suspension cable parts extending between the object suspension device and the departing sheave, and one or more second suspension cable parts extending between the object suspension cable device and the hoist cable retention device, such that the first and second suspension cable parts extend at a relatively large angle with respect to each other when the hoist cable retention device is mounted at the first mounting facility, and at a relatively small angle with respect to each other when the hoist cable retention device is mounted at the second mounting facility, and wherein at least one of the first mounting facility and the second mounting facility is embodied as a hole or a set of holes.

2. The double jib slewing pedestal crane according to claim 1, wherein the hoisting cable has a dead end connected to the hoist cable retention device.

3. The double jib slewing pedestal crane according to claim 1, wherein the second mounting facility is arranged half-way between the inner end and the outer end of the secondary jib.

4. The double jib slewing pedestal crane according to claim 1, wherein the hole or holes are provided in plates that form part of the secondary jib, which plates extend beyond a cross-sectional area of the secondary jib.

5. A vessel comprising a double jib slewing pedestal crane according to one of the preceding claims.

* * * * *